US011674773B2

(12) United States Patent
Nedev

(10) Patent No.: US 11,674,773 B2
(45) Date of Patent: Jun. 13, 2023

(54) FIREARM WITH AMBIDEXTROUS BOLT HOLD-OPEN

(71) Applicant: Caracal International, LLC, Abu Dhabi (AE)

(72) Inventor: Konstantin Nedev, Abu Dhabi (AE)

(73) Assignee: CARACAL INTERNATIONAL, LLC, Abu Dhabi (AE)

( * ) Notice: Subject to any disclaimer, the term of this patent is extended or adjusted under 35 U.S.C. 154(b) by 0 days.

(21) Appl. No.: 17/551,372

(22) Filed: Dec. 15, 2021

(65) Prior Publication Data

US 2022/0196361 A1 Jun. 23, 2022

Related U.S. Application Data

(60) Provisional application No. 63/128,244, filed on Dec. 21, 2020.

(51) Int. Cl.

| | |
|---|---|
| ***F41A 3/42*** | (2006.01) |
| ***F41A 35/06*** | (2006.01) |
| ***F41A 3/66*** | (2006.01) |

(52) U.S. Cl.

CPC ..... *F41A 35/06* (2013.01); *F41A 3/42* (2013.01); *F41A 3/66* (2013.01)

(58) Field of Classification Search

CPC ..... F41A 3/68; F41A 17/36; F41A 3/42

USPC ..... 89/138

See application file for complete search history.

(56) References Cited

U.S. PATENT DOCUMENTS

| | | | |
|---|---|---|---|
| 10,228,201 | B2 | 3/2019 | Walther et al. |
| 11,441,859 | B2 * | 9/2022 | Underwood ..... F41A 17/46 |
| 2005/0183310 | A1 | 8/2005 | Finn |

* cited by examiner

*Primary Examiner* — Reginald S Tillman, Jr.

(74) *Attorney, Agent, or Firm* — Bennet K Langlotz; Langlotz Patent & Trademark Works, LLC

(57) ABSTRACT

Firearms with ambidextrous bolt hold-open have a receiver defining a magazine well configured to receive an ammunition magazine having a follower that is spring biased toward an open end, the receiver defining a passage receiving a bolt assembly operable to reciprocate between a forward battery position and a rear retracted position, the bolt assembly being operable to strip a cartridge from the magazine upon movement from the rear retracted position to the forward battery position, a bolt latch movable between a latched position in which the bolt latch prevents movement of the bolt assembly from the retracted position to the battery position, and an unlatched position in which the bolt latch permits movement of the bolt assembly from the retracted position to the battery position, the bolt latch being responsive to the magazine having an elevated follower without ammunition to move to the latched position.

8 Claims, 4 Drawing Sheets

FIREARM WITH AMBIDEXTROUS BOLT HOLD-OPEN

CROSS-REFERENCE TO RELATED APPLICATION

This application claims the benefit of U.S. Provisional Patent Application No. 63/128,244 filed on Dec. 21, 2020, entitled "Bolt Catch," which is hereby incorporated by reference in its entirety for all that is taught and disclosed therein.

FIELD OF THE INVENTION

The present invention relates to firearms, and more particularly to a firearm that has a bolt catch that does not require a through cross-cut opening in the lower receiver.

BACKGROUND AND SUMMARY OF THE INVENTION

Semi-automatic rifles require a bolt catch to retain the bolt assembly in the retracted position when the magazine is empty. This enables the user to easily load the first round from a freshly inserted magazine. A disadvantage of traditional bolt catches is their requirement for a through cross-cut opening in the lower receiver that allows contamination to enter the firearm's internal working space and weakens the firearm's frame by reducing rigidity.

Therefore, a need exists for a new and improved firearm with ambidextrous bolt hold-open that has a bolt catch that does not require a through cross-cut opening in the lower receiver and enables the user to operate the bolt catch without changing their shooting posture. In this regard, the various embodiments of the present invention substantially fulfill at least some of these needs. In this respect, the firearm according to the present invention substantially departs from the conventional concepts and designs of the prior art, and in doing so provides an apparatus primarily developed for the purpose of enabling a bolt catch that does not require a through cross-cut opening in the lower receiver and enables the user to operate the bolt catch without changing their shooting posture.

The present invention provides an improved firearm with ambidextrous bolt hold-open, and overcomes the above-mentioned disadvantages and drawbacks of the prior art. As such, the general purpose of the present invention, which will be described subsequently in greater detail, is to provide an improved firearm with ambidextrous bolt hold-open that has all the advantages of the prior art mentioned above.

To attain this, the preferred embodiment of the present invention essentially comprises a receiver defining a magazine well configured to receive an ammunition magazine having a follower that is spring biased toward an open end, the receiver defining a passage receiving a bolt assembly operable to reciprocate between a forward battery position and a rear retracted opposition, the bolt assembly being operable to strip a cartridge from the magazine upon movement from the rear retracted position to the forward battery position, a bolt latch movable between a latched position in which the bolt latch prevents movement of the bolt assembly from the retracted position to the battery position, and an unlatched position in which the bolt latch permits movement of the bolt assembly from the retracted position to the battery position, the bolt latch being responsive to the magazine having an elevated follower without ammunition to move to the latched position, and the bolt latch being operable to reciprocate with respect to the receiver without rotation. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
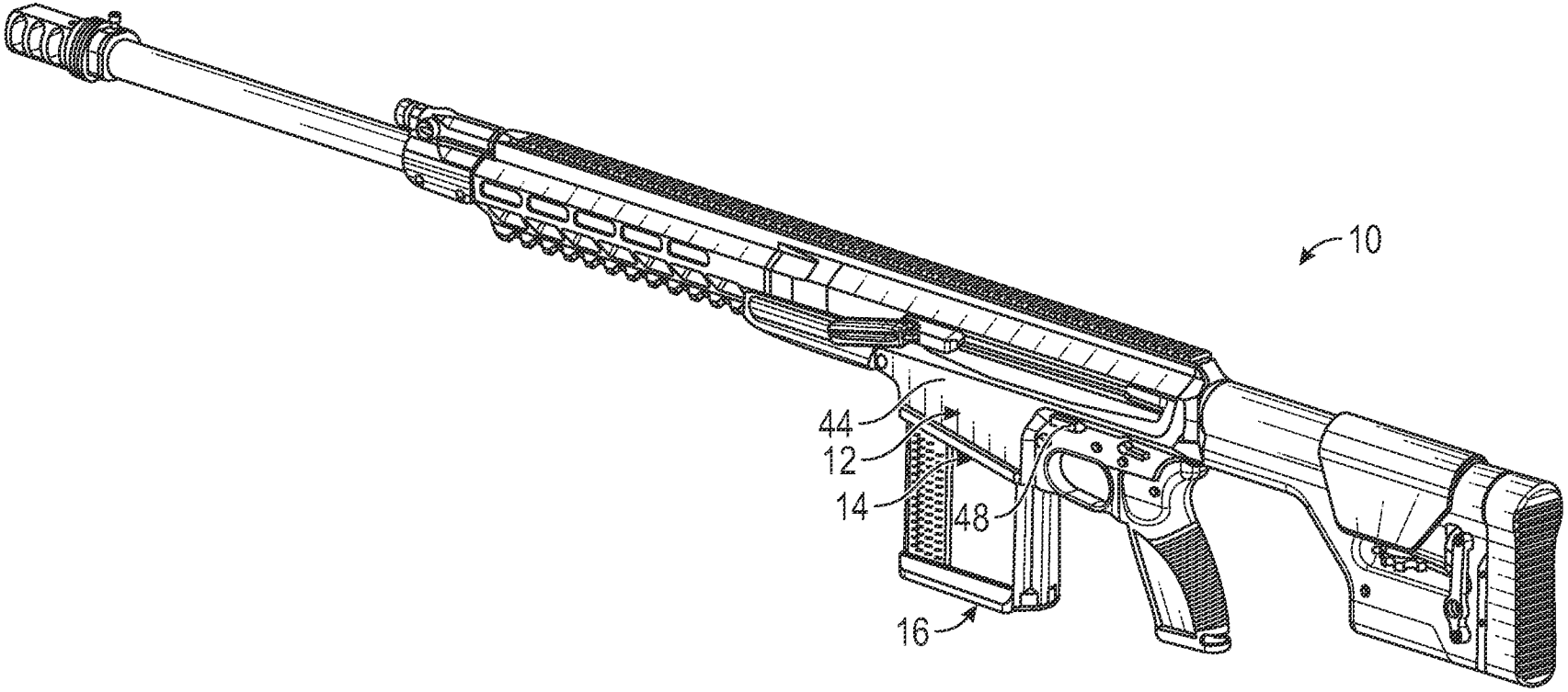
FIG. 1 is a top isometric view of the current embodiment of a firearm with ambidextrous bolt hold-open constructed in accordance with the principles of the present invention.
Figure 2:
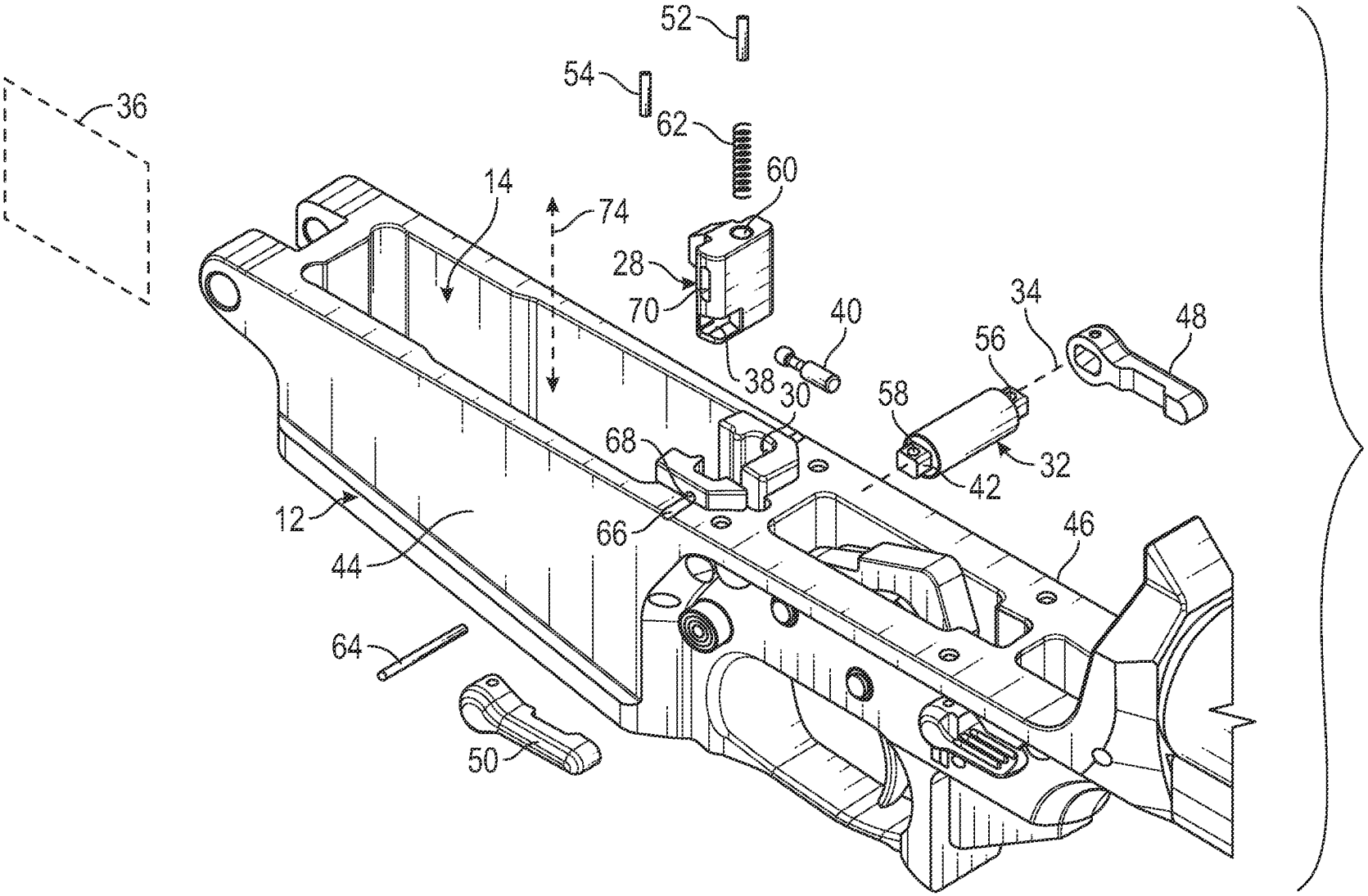
FIG. 2 is an exploded view of the receiver of FIG. 1.

An embodiment of the firearm with ambidextrous bolt hold-open of the present invention is shown and generally designated by the reference numeral 10.

Figure 3:
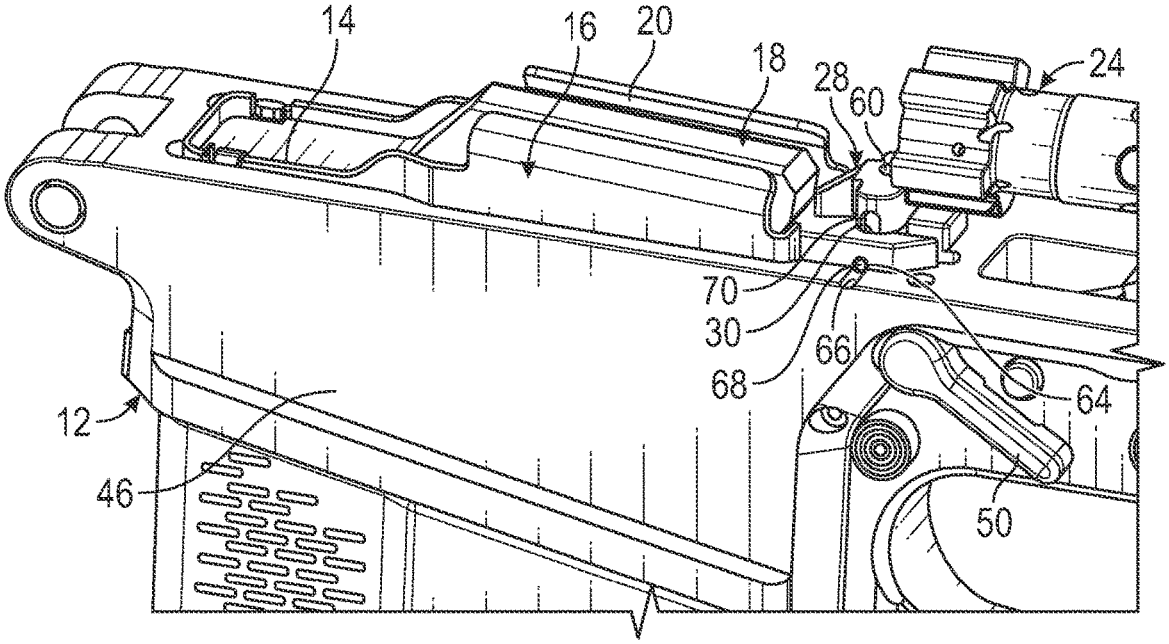
FIG. 3 is a right side view of the receiver of FIG. 1 with the bolt latch in the latched position.
Figure 4:
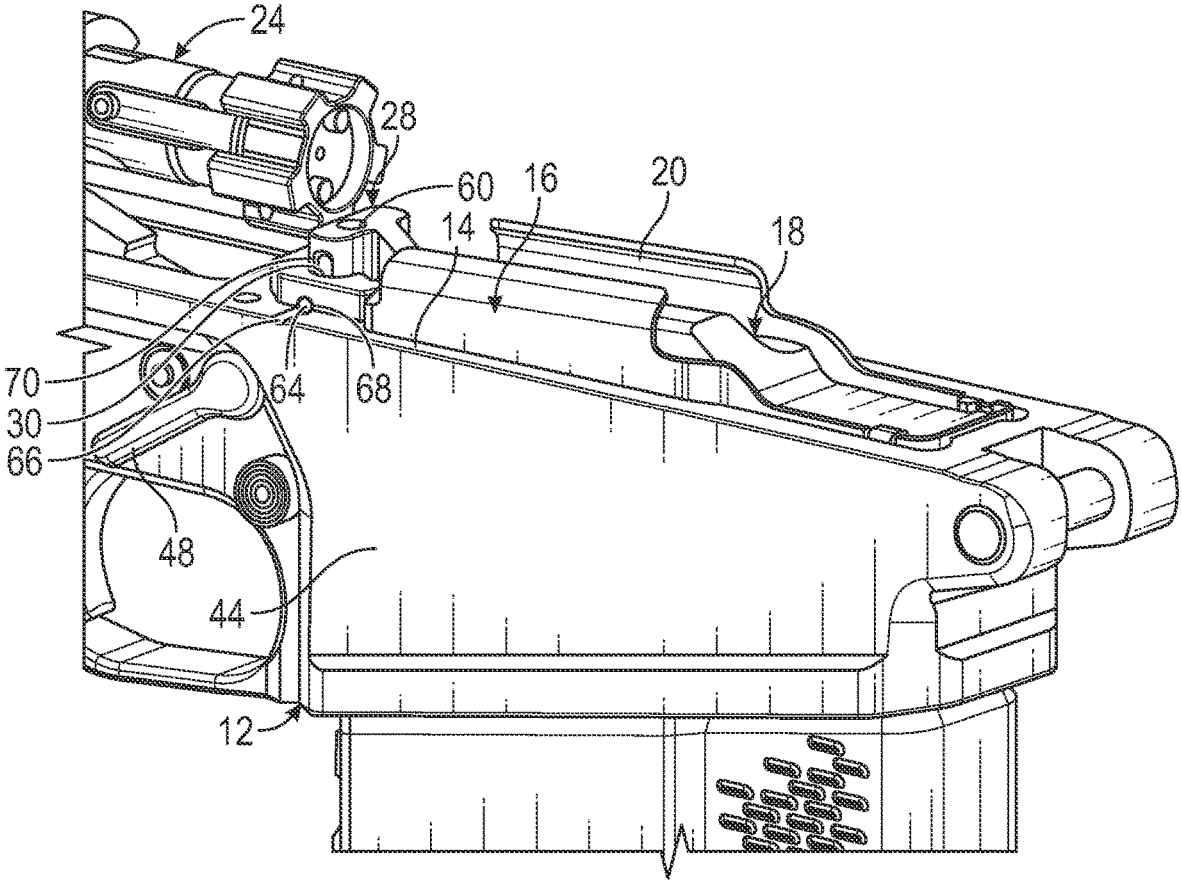
FIG. 4 is a left side view of the receiver of FIG. 1 with the bolt latch in the latched position.
Figure 5:
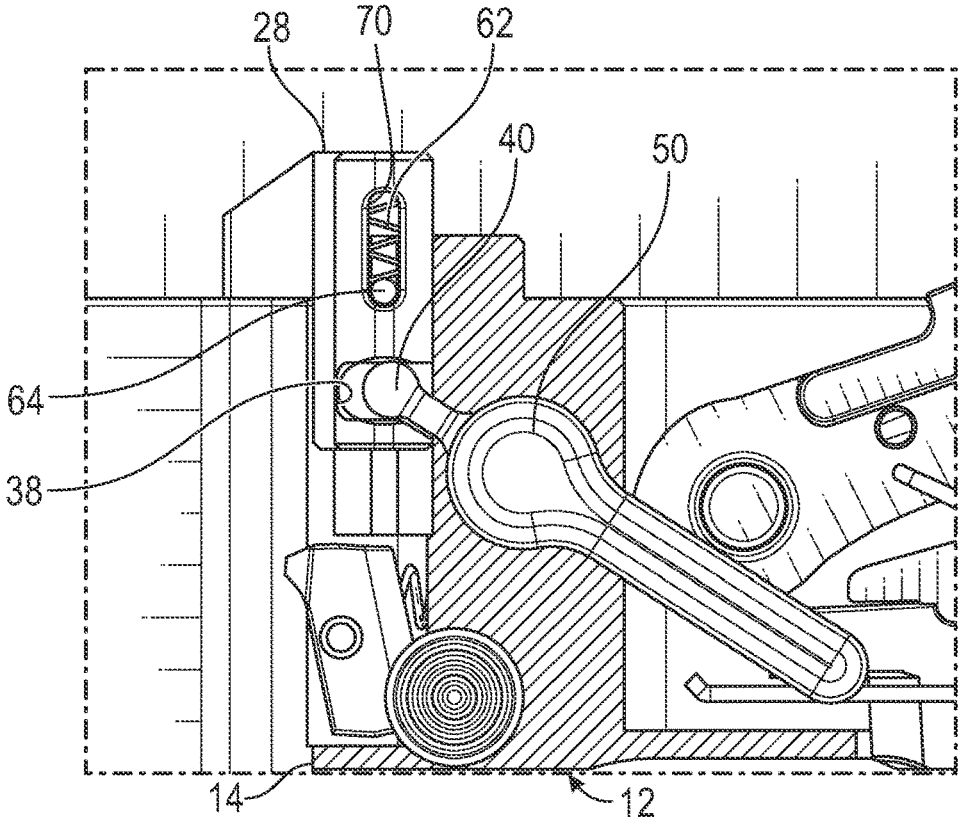
FIG. 5 is a side sectional view of the receiver of FIG. 1 with the bolt latch in the latched position.
Figure 6:
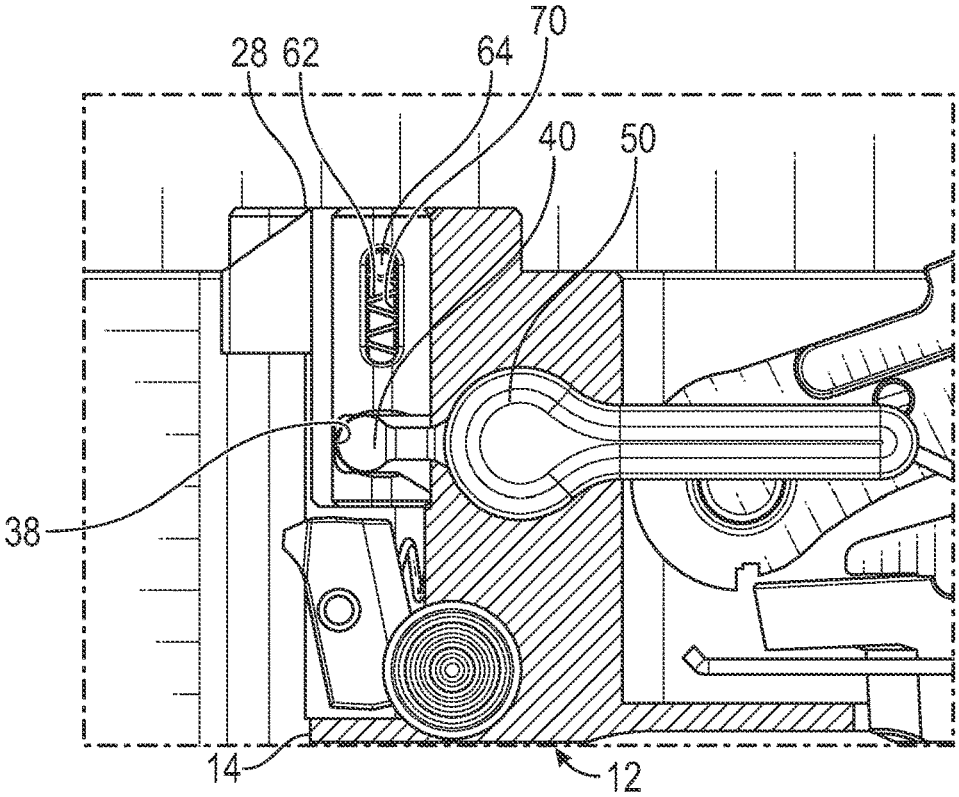
FIG. 6 is a side sectional view of the receiver of FIG. 1 with the bolt latch in the unlatched position.

FIG. 1 illustrates the improved firearm with ambidextrous bolt hold-open 10 of the present invention, and FIGS. 2-6 illustrate the improved receiver 12 of the present invention. More particularly, the receiver of the firearm defines a magazine well 14 configured to receive an ammunition magazine 16 having a follower 18 that is spring biased toward an open end 20. The receiver also defines a passage receiving a bolt assembly 24 operable to reciprocate between a forward battery position and a rear retracted position. The bolt assembly is operable to strip a cartridge from the ammunition magazine upon movement from the rear retracted position to the forward battery position. A bolt latch 28 connected to the receiver is movable between a latched position shown in FIGS. 3-5 in which the bolt latch prevents movement of the bolt assembly from the rear retracted position to the forward battery position, and an unlatched position shown in FIG. 6 in which the bolt latch permits movement of the bolt assembly from the retracted position to the battery position. The bolt latch is responsive to the ammunition magazine having an elevated follower without ammunition to move to the latched position, which is shown in FIGS. 3-5. A rear extension on the follower automatically actuates the bolt latch by lifting the bolt latch after the last cartridge has been fired. The bolt latch is operable to reciprocate with respect to the receiver without rotation.

The receiver 12 defines a passage 30 in which the bolt latch 28 is received for reciprocation. The bolt latch is constrained against pivoting with respect to the receiver. The magazine well 14 defines a vertical direction 74, and the bolt latch is operable to reciprocate in a vertical direction. A latch actuator 32 is pivotally connected to the receiver. The latch actuator pivots about a pivot axis 34 transverse to a medial plane 36 defined by the firearm 10. The bolt latch defines a gap 38, and the latch actuator includes an extending bulbous element 40 received in the gap. The latch actuator includes a shaft 42 extending through the receiver to opposed sides 44, 46 of the receiver. Two latch actuator levers 48, 50 are attached to opposed ends of the shaft by pins 52, 54 received in apertures 56, 58 defined by the opposed ends of the shaft. Two latch actuator levers enable ambidextrous operation of the latch actuator with the index finger of the user's shooting hand to manually actuate the latch actuator. The position of the latch actuator levers also performs the important function of providing a clear visual marker for the ammunition magazine 16 being empty. The latch actuator levers are positioned at an angle relative to the receiver when the bolt assembly 24 is held back by the bolt latch in the latched position, and are positioned horizontally to the receiver when the bolt assembly is free to reciprocate with the bolt latch in the unlatched position. The visual marker function of the latch actuator levers is particularly important because the firearm 10 operates with a closed extraction port cover. The bolt latch defines a vertical aperture 60 that receives a spring 62 that biases the bolt latch downwards, but is able to be overcome by the follower spring (not shown). A pin 64 is received in a groove 66 and aperture 68 defined by the receiver along with a slot 70 defined by the bolt latch to constrain the vertical movement of the bolt latch and prevent rotation.

It should be appreciated that the firearm with ambidextrous bolt hold-open 10 omits a traditional, AR-type through crosscut/opening in the receiver 12 that would allow debris and dirt to enter the firearm's internal working space and weaken the receiver.

In the context of the specification, the terms "rear" and "rearward," and "front" and "forward" have the following definitions: "rear" or "rearward" means in the direction away from the muzzle 90 of the firearm while "front" or "forward" means it is in the direction towards the muzzle of the firearm.

While a current embodiment of a firearm with ambidextrous bolt hold-open has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm defining a vertical medial plane, the firearm comprising:

a receiver defining a magazine well configured to receive an ammunition magazine having a follower that is spring biased toward an open end;

the receiver defining a passage receiving a bolt assembly operable to reciprocate between a forward battery position and a rear retracted position;

the bolt assembly being operable to strip a cartridge from the ammunition magazine upon movement from the rear retracted position to the forward battery position;

a bolt latch movable between a latched position in which the bolt latch prevents movement of the bolt assembly from the rear retracted position to the forward battery position, and an unlatched position in which the bolt latch permits movement of the bolt assembly from the rear retracted position to the forward battery position;

the bolt latch being responsive to the ammunition magazine having an elevated follower without ammunition to move to the latched position;

the bolt latch being operable to reciprocate with respect to the receiver without rotation, including a latch actuator pivotally connected to the receiver; and wherein the latch actuator pivots about a pivot axis transverse to the medical plane.

2. The firearm of claim 1 wherein the receiver defines a passage in which the bolt latch is received for reciprocation.

3. The firearm of claim 1 wherein the bolt latch is constrained against pivoting with respect to the receiver.

4. The firearm of claim 1 wherein the magazine well defines a vertical direction, and the bolt latch is operable to reciprocate in a vertical direction.

5. The firearm of claim 1 wherein the bolt latch defines a gap, and the latch actuator includes an extending bulbous element received in the gap.

6. The firearm of claim 1 wherein the latch actuator includes a shaft extending through the receiver to opposed sides of the receiver.

7. The firearm of claim 1 wherein the latch actuator includes opposed latch actuator levers on opposite sides of the medial plane.

8. The firearm of claim 7 wherein the latch actuators levers are fixed together to operate as a single unit.

* * * * *